US005485908A

United States Patent [19]

Wang et al.

[11] Patent Number: 5,485,908

[45] Date of Patent: Jan. 23, 1996

[54] PATTERN RECOGNITION USING ARTIFICIAL NEURAL NETWORK FOR COIN VALIDATION

[75] Inventors: Chuanming Wang; Mark H. Leibu, both of St. Louis, Mo.

[73] Assignee: Coin Acceptors, Inc., St. Louis, Mo.

[21] Appl. No.: 273,931

[22] Filed: Jul. 12, 1994

[51] Int. Cl.[6] ..... G07D 5/08

[52] U.S. Cl. ..... 194/317

[58] Field of Search ..... 194/317, 318, 194/319

[56] References Cited

U.S. PATENT DOCUMENTS

| | | | |
|---|---|---|---|
| 4,625,852 | 12/1986 | Hoormann | 194/317 |
| 4,646,904 | 3/1987 | Hoormann | 194/334 |
| 4,739,869 | 4/1988 | Hoormann | 194/317 |
| 5,142,665 | 8/1992 | Bigus | 395/21 |
| 5,167,313 | 12/1992 | Dobbins et al. | 194/317 |
| 5,247,584 | 9/1993 | Krogmann | 382/14 |

FOREIGN PATENT DOCUMENTS

| | | | |
|---|---|---|---|
| 4-123191 | 4/1992 | Japan | 194/317 |

*Primary Examiner*—F. J. Bartuska
*Attorney, Agent, or Firm*—Haverstock, Garrett & Roberts

[57] ABSTRACT

A coin validation system for determining if a coin moving along a coin rail is a valid coin, and if so, its denomination the system including a rail along which coins move, at least one optical sensor located along the rail to sense the presence or absence of a coin moving therealong, at least one magnetic sensor associated with each optical sensor located in the vicinity of the respective optical sensor, each of the magnetic sensors including an inductive element and a circuit for exciting the magnetic sensor to produce a field that is coupled to the coin moving past so that the coin and the inductive element have mutual inductance therebetween, the circuit ringing the magnetic sensor a predetermined number of times while the coin is adjacent to the magnetic sensor whereby the magnetic sensor generates a damped wave signal having characteristics representative of the physical and magnetic characteristics of the coin, a signal preprocessor operatively connected to the magnetic sensor for producing output responses representative of distinguishing characteristics of the coin, a feature extraction circuit for extracting from the output responses of the signal preprocessor signal portions representative of predetermined distinguishing characteristics of the coin, a circuit for producing a multi-dimensional representation of the extracted features and for comparing the multi-dimensional representation with the center of an established ellipsoidal cluster of selected coin denominations to determine the extent of the comparison therebetween and to be used to determine whether the coin is an acceptable coin or not, and an artificial neural network classifier circuit having connections to the preprocessor and to the comparator circuit, the neural network classifier circuit having an output which identifies the denomination of coins that are determined by the comparator circuit to be acceptable.

18 Claims, 5 Drawing Sheets

PATTERN RECOGNITION USING ARTIFICIAL NEURAL NETWORK FOR COIN VALIDATION

Devices for recognizing, identifying and validating objects such as coins are widely used in coin acceptor and coin rejecter mechanisms and many such devices are in existence and used on a regular basis. Such devices sense or feel the coin or other object as it moves past a sensing station and use this information in a device such as a microprocessor or the like to make a determination as to the genuinous, identity and validity of each coin. Such devices are very successful in accomplishing this. However, one of the problems encountered by such devices is the presence of variations in the same type of coin from batch to batch and over time and other variables including wear and dirt. These will cause changes, albeit small changes in some cases and from one coin type to another including in the U.S. and foreign coin markets. Such changes or variations can make it difficult if not impossible to distinguish between genuine and counterfeit coins or slugs where the similarities are relatively substantial compared to the differences.

The present invention takes a new direction in coin recognition, identification and validation by making use of artificial neural network (ANN) technology. This technology has not been used heretofore in devices for sensing, identifying, recognizing and validating coins such as the coins fed into a vending or like machine. The use of ANN has the advantage over known devices by constantly upgrading its parameters of recognition or fingerprint that is initially established for each coin denomination before the device is put in operation. In other words, as each new coin of the same or different type moves past the sensing means employed in the present device, the pattern of recognition that has been established for each such coin, over time, can be modified or "updated" so that any changes in the coins that are sensed over short or even over long periods of time are self-adjusting and this can greatly improve the quality of recognition, identification and validity evaluations thereby also making it possible to reduce the number of losses that are encountered by vending machines. It may also increase the number of valid coins that a machine will accept.

The present invention therefore represents a new use of an existing technology in a coin sensing environment which has not occurred in the past.

SUMMARY OF THE INVENTION

The present invention allows for the association of artificial neural network (ANN) technology to be used to determine recognition, identification and validity of metal objects such as coins by using the technology to update the parameters or weights used in establishing whether a coin is valid or not and to identify the type or denomination of coin it is.

In accordance with the present invention, a category representation of each object is established and if a sufficient match is made between the center of an established category representation and the pattern created by a new coin moving into the system for identification, then the coin will be identified as to its type or denomination and as to whether or not it is a valid coin all based on the similarities or dissimilarities between the center and the patterns.

With the present system it is recognized that each different coin denomination will have its own pattern and the same system can be used to recognize, identify and validate, or invalidate, coins of more than one denomination including coins of different denominations from the U.S. and foreign coinage systems.

The novelty of the present invention relates in large part to the signal processing and multi-frequency testing means and methods that are used. The signal processing involves extracting features from signals generated during passage of a coin and interpreting these signals in a pattern recognition process. Pattern recognition and neural network technologies are employed in the present device in a manner to increase the performance sensitivity without adding new or more complicated sensors. In a preferred embodiment of the present device two pairs of coils are programmed to be connected to result in four tank circuits (4 frequencies) using switching means such as reed switches to switch in and out parallel capacitors. This produces a relatively wide range of frequencies capable of covering a large range of coins including coins of many sizes and denominations.

The present device establishes different arbitrary boundaries for each different denomination coin to be distinguished and validated, and as a new coin moves along next to the sensors it produces signals in the tank circuits and optical sensors which are used to generate patterns. As far as validation is concerned two matters are addressed; first, to verify if the object or coin under test is valid or counterfeit, and, second, once it is determined to be a valid coin to determine its denomination. The number of categories into which an object or coin can be classified is usually known and samples are available for comparison and test purposes. Furthermore, each coin when magnetically and optically sensed will produce a distinctive feature vector, and these can be close to one another for some closely related objects or coins.

Pattern recognition has been employed in coin classification heretofore (Barlach) but the known methods of pattern recognition have been of limited value and typically have not been sufficiently reliable as a means to distinguish valid coins from others. The emergence of artificial neural network (ANN) technology has been demonstrated to be a powerful and reliable classifier in pattern recognition. For example, ANN has the capability to form a classifier pattern with any desired arbitrary and irregular shaped boundaries over a feature vector space. With prior devices the classification decisions that were made were thereof based on a sequence of boundary checking steps using limited extracted information. This problem is overcome by the present device which produces multiple frequency responses generated by uniquely controlled magnetic sensors. The manner in which the sensors are controlled to produce the multi-frequency outputs is important to the present invention. The present device includes the sensors, the signal conditioning circuits including the means for controlling the sensors, data acquisition means, feature processing and extraction means and the classifier means. The physical characteristics of the sensors may be of known construction such as shown in Hoorman U.S. Pat. No. 4,625,852 and Hoorman U.S. Pat. No. 4,646,904. The present device controls the sensors in a different way from prior controls and in so doing produces more different frequency outputs resulting in better identification and classification of coins or other objects. The present device takes this information and classifies the objects or coins into the requisite coin denominations or into counterfeits, slugs or other non genuine objects

OBJECTS OF THE INVENTION

It is a principal object of the present invention to provide improved means for recognizing, identifying and validating coins of one or more denomination.

Another object is to use artificial neural network (ANN) technology to identify and validate coins of the same or different denomination.

Another object is to provide relatively simple means for using ANN technology in a coin validation environment.

Another object is to increase the accuracy, reliability and consistency of coin recognition, coin identification and coin validation.

Another object is to use ANN classification means for the validation of coins and other monetary means.

Another object is the use of pattern recognition technology to reduce the domain of a feature space over which an ANN can be easily implemented and trained.

Another object is to be able to extract more information from a magnetic sensor device because of the way it is controlled when the information is produced including by the number of frequencies that are generated.

Another object is to use multi-frequency testing to generate patterns to represent objects.

These and other objects and advantages of the present invention will become apparent to those skilled in the art after considering the following detailed specification of preferred embodiments in conjunction with the accompanying drawings.

MULTI-FREQUENCY METHOD—IMPLEMENTATIONS

The term multi-frequency indicates that the testing signal has more than one frequency component at different time intervals.

DESCRIPTION OF THE PREFERRED EMBODIMENTS

Figure 1:
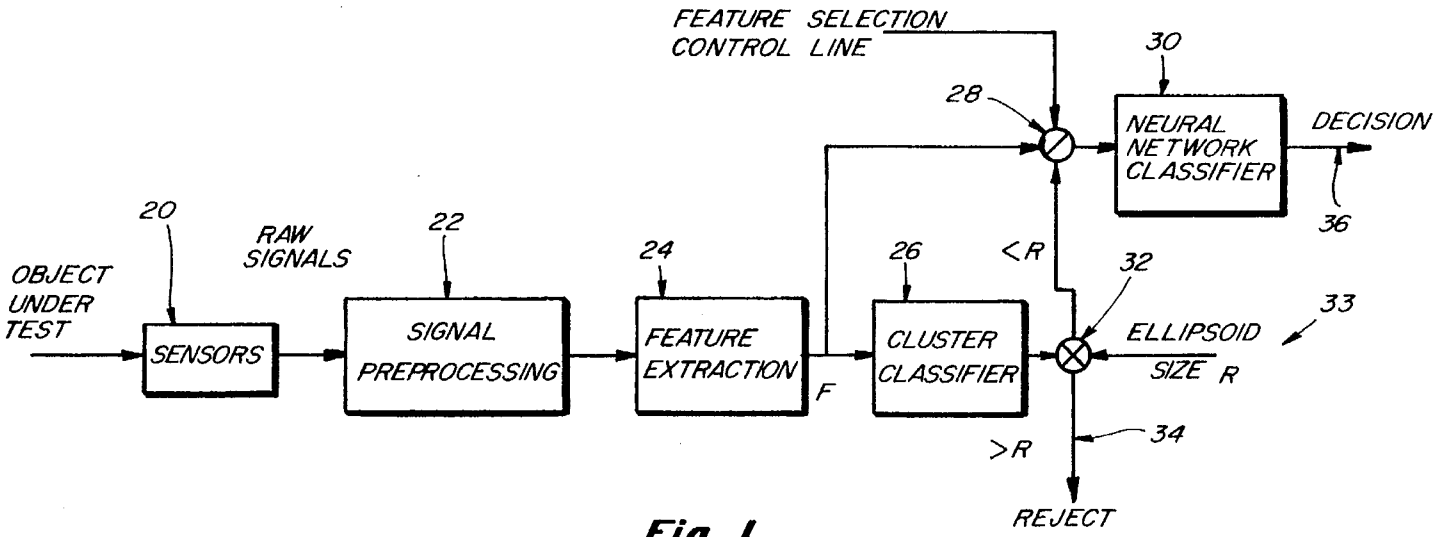
FIG. 1 is a schematic block diagram of a coin validation system constructed according to the present invention.

Referring to the drawings more particularly by reference numbers, number 20 in FIG. 1 refers to the sensors used in the present device. The sensors are mounted adjacent to a coin track 21 along which coins or other objects to be sensed move. The construction of the sensors 20 is important to the invention and will be described more in detail hereinafter.

The outputs of the sensors 20 typically include four signals of different frequencies which are fed to a signal preprocessing circuit 22, the outputs of which are fed to a feature extraction algorithm 24 constructed to respond to particular features of the signals produced by the sensors. The feature extraction algorithm 24 produces outputs that are fed to a cluster classifier device 26 and also to a switch 28 which has its opposite side connected to a neural network classifier circuit 30. The neural network classifier circuit 30 includes means for producing decision outputs based upon the inputs it receives.

The cluster classifier device 26 has an output on which signals are fed to a comparator circuit 32 which receives other inputs from an ellipsoid shaped raster or area 33. The outputs of the comparator circuit 32 are fed to the switch 28 for applying to the neural network classifier 30. The comparator 32 also produces outputs on lead 34 which indicate the presence of a rejected coin. This occurs when the comparator circuit 32 generates a comparison of a particular type. A description of the decisions produced on output 36 of the neural network classifier 30 will be described later.

Figure 2:
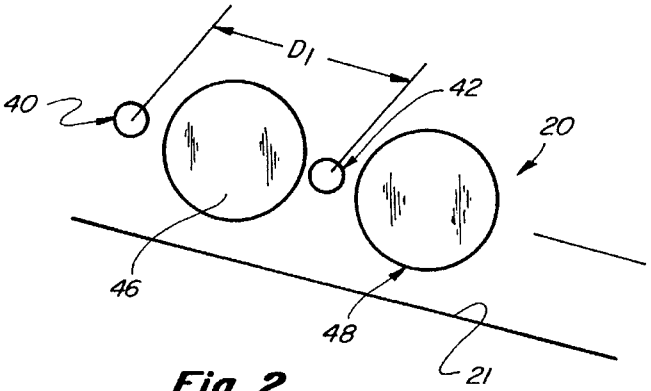
FIG. 2 is a side elevational view showing one arrangement for the locations of optical and magnetic sensors along a coin track for producing signal responses representative of certain characteristics of each coin as it passes.
Figure 4:
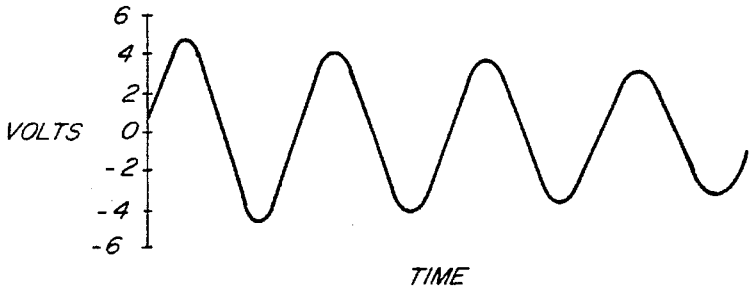
FIG. 4 is a damped sinusoidal signal of the type generated by a LC tank circuit.

The sensors 20 employed in the subject device are shown schematically in FIG. 2 and include two spaced optical sensors 40 and 42, located at spaced locations along the coin track 21, and two spaced magnetic sensors 46 and 48, also located at spaced locations along the coin track 21. The optical sensors 40 and 42 are shown spaced upstream respectively of the magnetic sensors 46 and 48 and therefore respond to movements of each coin along the coin track 21 just before the coin reaches the respective magnetic sensor 46 or 48. The optical sensors 40 and 42 monitor the coin track 21 and generate pulse signals as a coin blocks and unblocks their optical paths. These pulse signals provide coin chord size information and also synchronize the oscillations that takes place in the magnetic sensors 46 and 48 so that the signals from the coils in the magnetic sensors reflect the coin presence and generate signals that represent certain characteristics of each coin. The magnetic sensors may be of a known construction but are controlled to operate differently in the present circuit than in any known circuit. For example, each of the magnetic sensors 46 and 48 includes a pair of coils connected magnetically in aiding and opposing manner respectively under control of the operation of the respective optical sensor 40 or 42. When operating in the aiding and opposing manners each pair of coils oscillates at its respective natural frequency, and this occurs once the object or coins is present in the field of the respective sensor and in so doing provides magnetic information about the coin. The signals collected by the sensors 40 and 42 arc processed by the signal preprocessing means 22. Extraction of the most dominate and salient information about the coin occurs in the feature extraction circuit 24. A feature vector (FV) is formed by combining all of the preprocessed information, and this feature vector (FV) is then fed to the hyper ellipsoidal classifier circuit 26 which classifies the object or coin according to its denomination. If the object or coin is not classifiable by its denomination because it is a counterfeit coin or slug, the classifier circuit will produce an output from a comparator 32 that is used to reject the coin. This is done by producing a signal on lead 34. The classification of the coin takes place in the comparison means 32 which compares the output of the cluster classifier 26 with an ellipsoid shaped output received on another input to the comparator 33.

Figure 3:
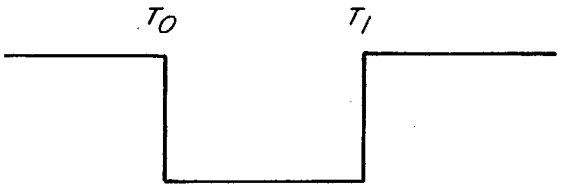
FIG. 3 is a graph of pulse signals generated by spaced optical sensors as an object such as a coin moves past.
Figure 3:
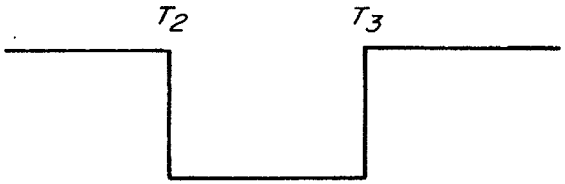
Figure 11:
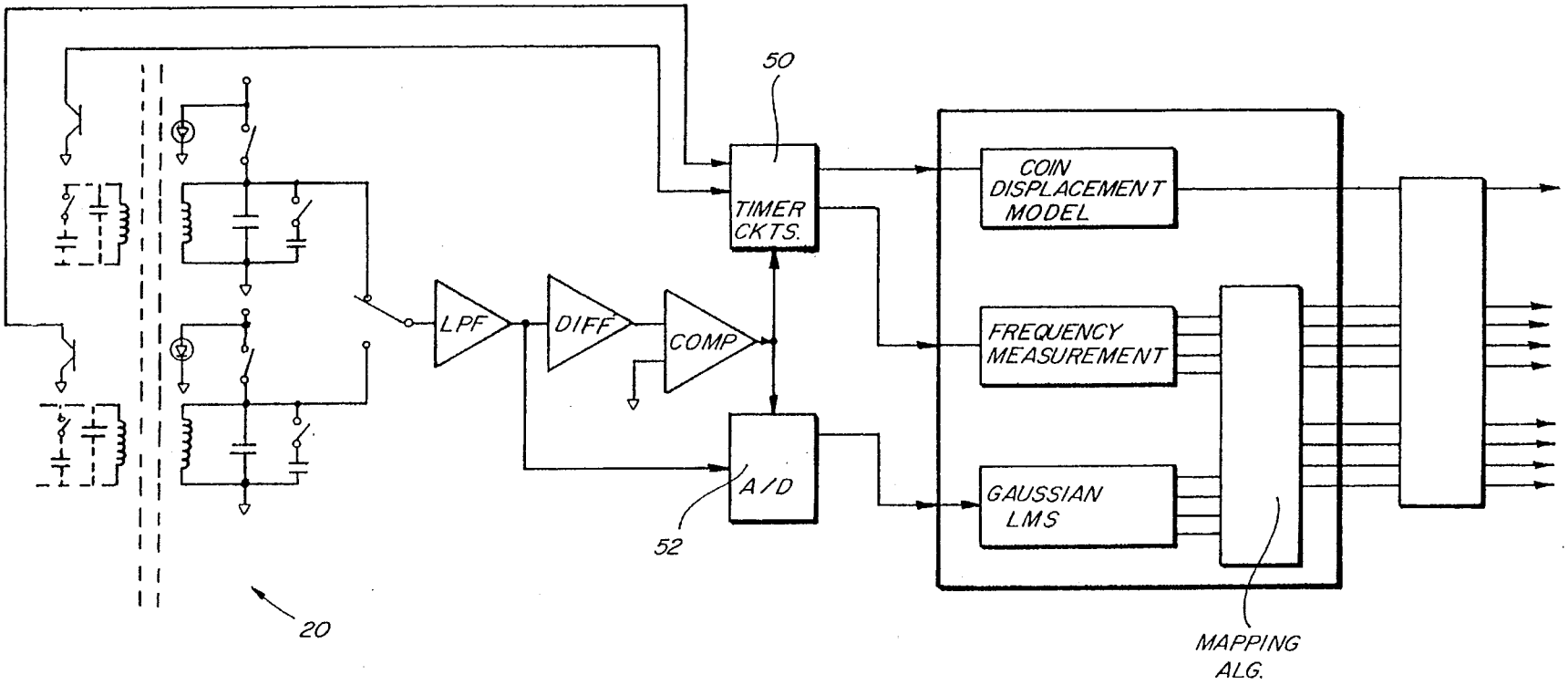
FIG. 11 is a block diagram of the circuit of the subject device with the appropriate legends on the circuit blocks.

FIG. 3 shows examples of pulse signals that are generated by the optical sensors 40 and 42 as a coin moves down the coin track 21. When the first pulse is produced, a timer is energized commencing at time ($t_0$), and subsequent pulses generated by the optical sensors interrupt the timer at times $t_1$, $t_2$, and $t_3$ (FIG. 3.). The interrupt signals at times $t_1$, $t_2$ and $t_3$ are associated with movements of the object under test and are used for further processing including for turning on the magnetic sensors 46 and 48 in particular manners and at particular times to produce particular output signals. The signals from the optical and magnetic sensors are transformed into "coin features" and are collected into a coin features vector (FV) for each coin. The time and magnetic characteristics of the signals are processed by "timers" 50 and "peak detector" circuits shown in FIG. 11. The peak detector outputs are converted into numerical values by an analog to digital converter circuit 52. The "timer" records the time intervals by which the optical elements are covered by each coin and these values are related to coin size and is one component of the coin feature vector.

The coin feature vector is presented to the ANN 30 which is a three layer network in the present device. The first layer FIGS. 7, 8 and 9, has two types of neurons. One type performs ellipsoidal clustering which outputs one or zero if the feature is located outside or inside the ellipsoid. The other neurons are feed forward reception neurons. They form an arbitrary decision region within the ellipsoid. The output of network is a single neuron sometimes called the "winner takes all" neuron 56. This is shown in FIG. 9 in the drawings.

Generally speaking only peak values of the damped sinusoidal wave form are collected to reduce the number of digitized data points to a manageable number. To accomplish this, a differentiator 54 is used to find the derivative of the voltage ($V_t$) and this triggers the analogue-to-digital convertor 52 each time the output crosses zero. This way of handling the data simplifies the number of data points that need to be considered.

The signal preprocessing means 22 which receives the outputs of the magnetic sensors 46 and 48 may contain redundant and/or irrelevant material. The signal preprocessing means 22 extracts as much as possible of the more dominant and salient information from the signals, and from this information forms a discriminative feature vector (FV) that is used for classification purposes. The preprocessing step is an important step for increasing the efficiency of the classifiers 26 and 30. The information in the output of the signal preprocessor 22 contains several pieces of information including information as to the size and magnetic characteristics of the object or coin in question. Size information is obtained primarily from the optical signals produced by the optical sensors 40 and 42. The means for measuring distance or coin size may assume that the coin moves at a constant acceleration through the acceptor.

The damped sinusoidal waveforms generated by the tank circuits when a coin is present contain information which relates to the magnetic characteristics of the coin, i.e. the coin size, coin conductivity, permeability and the depth of penetration. Each damped sinusoidal wave form has several parameters of importance including parameters as to amplitude, damping factor, angular frequency and phase angle. Certain of these characteristics such as amplitude and phase angle are determined not only by the object under test but also by the initial condition of the tank circuit. This being so they are not good feature candidates because of their variances due to the initial conditions of the tank circuit. The other two parameters, namely, the damping factor and angular frequency are dependent upon tank circuit components only and are included in the feature vector (FV). It is preferred to choose fundamental features which are more directly related to the object or coin under test, if possible. These features are extracted from the output of the magnetic sensors. The magnetic sensors are able to detect subtle changes in the metal material of the coin or other object under test.

Figure 5:
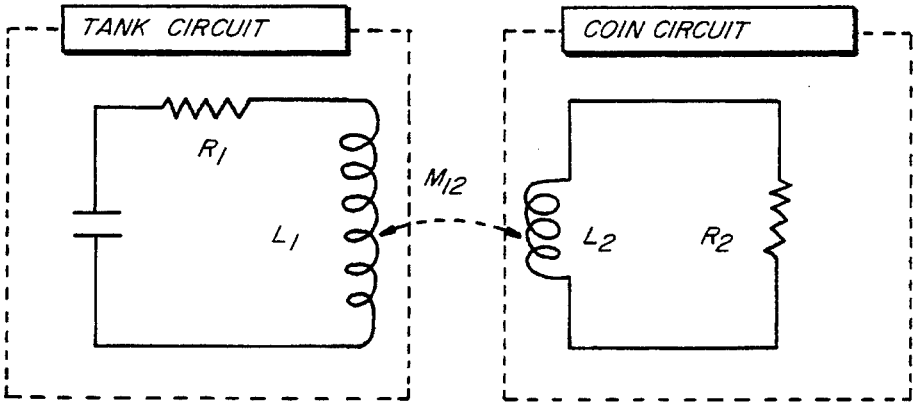
FIG. 5 is a schematic circuit of a coil excited by an AC source when a coin is adjacent to it, said circuit being shown as a transformer circuit with a coin adjacent thereto.

FIG. 5 illustrates how a pair of secondary circuit metal objects such as coins can be modeled as a secondary circuit in a transformer-like situation so that each has its own inductance L2 and its own series resistance R2. $M_{12}$ is the mutual inductance between the coils $L_1$ and $L_2$, and k is the coefficient of coupling between the two coils. In the circuit of FIG. 5, $L_1$ and $R_1$ are constants in a particular validation unit and can be estimated as air parameters when no object or coin is present at the location of the coil. By contrast, $L_2$ and $R_2$ which relate to the coin, depend upon completing the material characteristics of the coin under test. Any subtle difference in material in the coin will directly and immediately change $L_2$ and $R_2$ and these subtle differences will be reflected in the outputs of the magnetic sensors as the coin moves by. The coin therefore forms a secondary circuit having its own inductance and resistance as shown in FIG. 5. The inductance and resistance of each tank circuit are constants in a particular unit and are known when no object is present. This means that even small changes in L and R will appear in the feature vector (FV). When a tank circuit is rung the shape of the damped sinusoidal waveform that is produced will depend on the capacitance, the inductance and the equivalent resistance of the coil. The damping factor and the angular frequencies can be determined mathematically, if we know the value of the capacitance, the inductance and the resistance. However, we don't know these values. Therefore Gauss least square means are used to estimate these parameters.

In a typical application the tank circuits are activated four times when an object or coin is present. This means that four changes in the resistance and in the inductance based on the different tank circuit characteristics or combinations will be produced and collected. This will also be based on the damping factors and frequencies of the respective tank circuits. These changes in resistance and inductance plus the changes in the cords of the damped waves produced constitute the feature vector (FV) for each object or coin under test. Thus each object or coin will have its own feature vector and the feature vector will distinctively represent that particular coin.

The cluster classifier 26 and the neural network classifier 30 are constructed to search for an optimal partition of a feature space S into c regions which we will call decision regions where c is the number of classes or decision regions in a feature space. The classifier should have the capability to correctly and/or meaningfully assign a class label to a feature vector (FV) in the feature space (S). A classifier design can be divided into two categories, one being supervised learning and the other unsupervised learning. In the present coin validation means supervised learning is employed since labeled samples are available, one for each different coin denomination. There are two kinds of decision regions defined in a coin feature space (S), one being acceptance regions and the other being rejection regions. If a feature vector (FV) falls in one of the acceptance regions the object associated with it is classified as a coin, otherwise it is rejected. The rejection region overlays almost the entire feature space except for a number of small acceptance regions.

Figure 6:
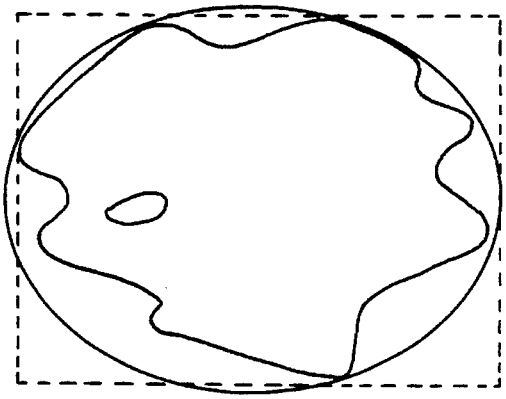
FIG. 6 is a planar view showing various overlapping decision regions illustrating the boundaries formed by different classifier designs. The arbitrary and irregular boundary is employed in the present invention.

FIG. 6 illustrates a two dimensional decision region. An ellipsoidal cluster forms a semi-regular partition region with abrupt boundaries in a feature space (S) while a neural network on the other hand constructs any arbitrary and irregular decision region in the ellipsoid. An ellipsoidal boundary is generally much better than a rectangular shaped one. Some regions in the pattern may have holes which cause discontinuous decision boundaries. The complimentary functions of these two region types produces a classifier which has very fine resolution at the decision border and irregularity in decision region geometry. In the case of coin validation means a data base of coins and counterfeits is created by initially inserting them into the validation system. Each record in the data base has an associated feature vector (FV), a label of some kind to identify a coin from a counterfeit, and a denomination if it is labeled as a coin. The number of records for each category is determined by the distribution and features of the feature vector (FV).

An ellipsoidal cluster E in a p-dimensional Euclidian space having a size r established in which the eccentricity and orientation of the cluster space or ellipsoid is determined. There is one ellipsoidal cluster for each coin category. It can be shown mathematically that the center of the ellipsoid is the average of all samples belonging to the same class and the axis of the ellipsoid is defined by the standard deviations of each element in the feature vector.

Once this information has been established, the distance of a point in the feature vector (FV) to the cluster can be determined. The distance as defined for these point are used to make preliminary decisions. For example, an object with a feature vector (FV) is a candidate for a certain class coin if the distance from the feature vector to the cluster is less than or equal to some distance. However this is not a final decision as to the coin's acceptability for several reasons. First, the real cluster geometry of the samples may form an ellipsoid whose axes are oblique to the coordination axes and the principal component method may be used to rotate the ellipsoid. Secondly, regardless of the first reason the decision region formed by an ellipsoid is still regarded as a semi-regular region and counterfeit overlapping volume may be observed within the ellipsoid. Therefore, an artificial neural network ANN is further used to alternate the decision region within the ellipsoid. This combination of a cluster and an ANN makes the training of the ANN much easier because the domain of a mapping on which an ANN is defined is much smaller than the entire feature space.

An artificial neural network is a collection of parallel processing elements called neurons linked by their synaptic weights. These neurons can be arranged in several layers. Designing a neural network for a pattern recognition application is to train the neural network to identify a partition in a feature space. Theoretically, as long as the number of neurons in the hidden layer is sufficiently large any vector input-output mapping can be realized by a multi-layer feed forward neural network. Supported by this theory, a decision region with arbitrary geometric boundaries can be realized by a neural network.

Figure 7:
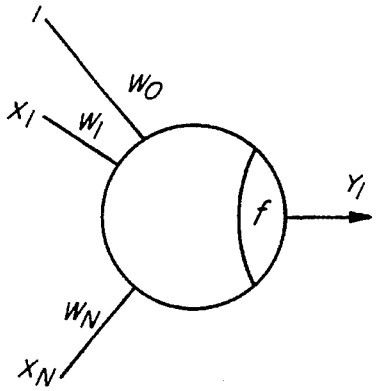
FIG. 7 is a side elevational view illustrating an artificial neuron which simulates a biological nerve cell.
Figure 8:
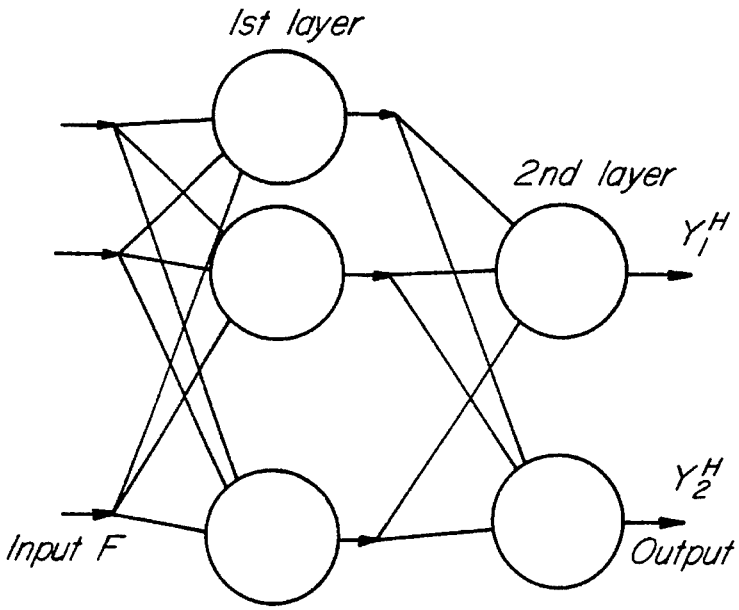
FIG. 8 illustrates a two-layer artificial neural network.
Figure 9:
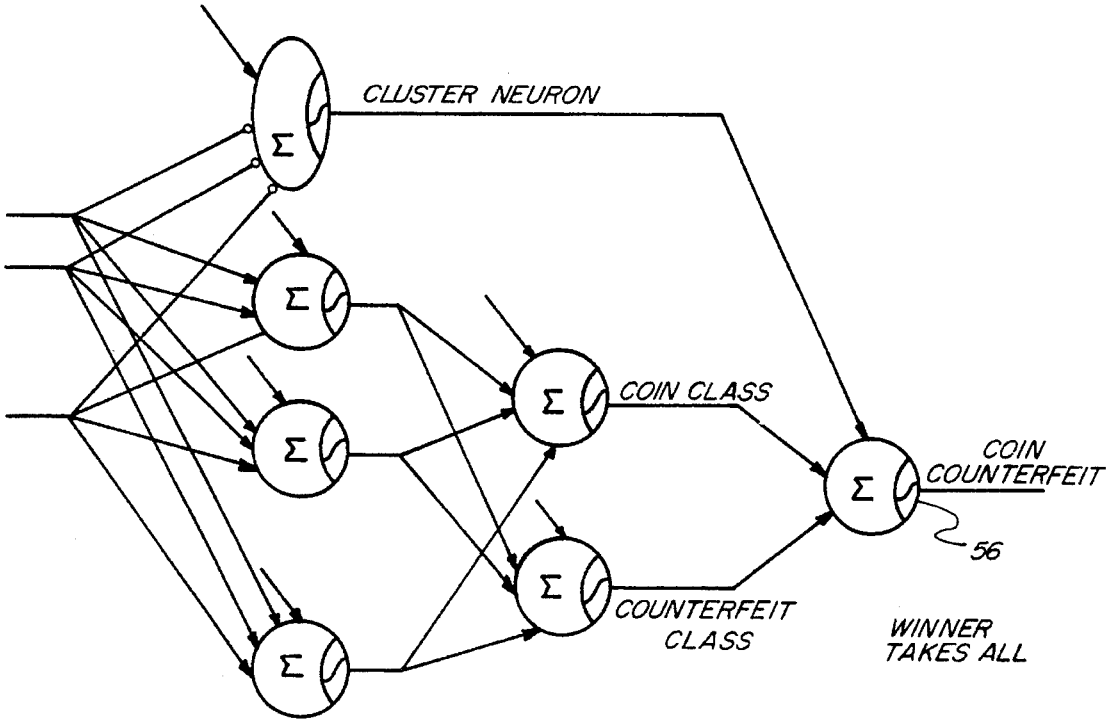
FIG. 9 is a three layer artificial neural network with a "winner-take-all" output layer.
Figure 10:
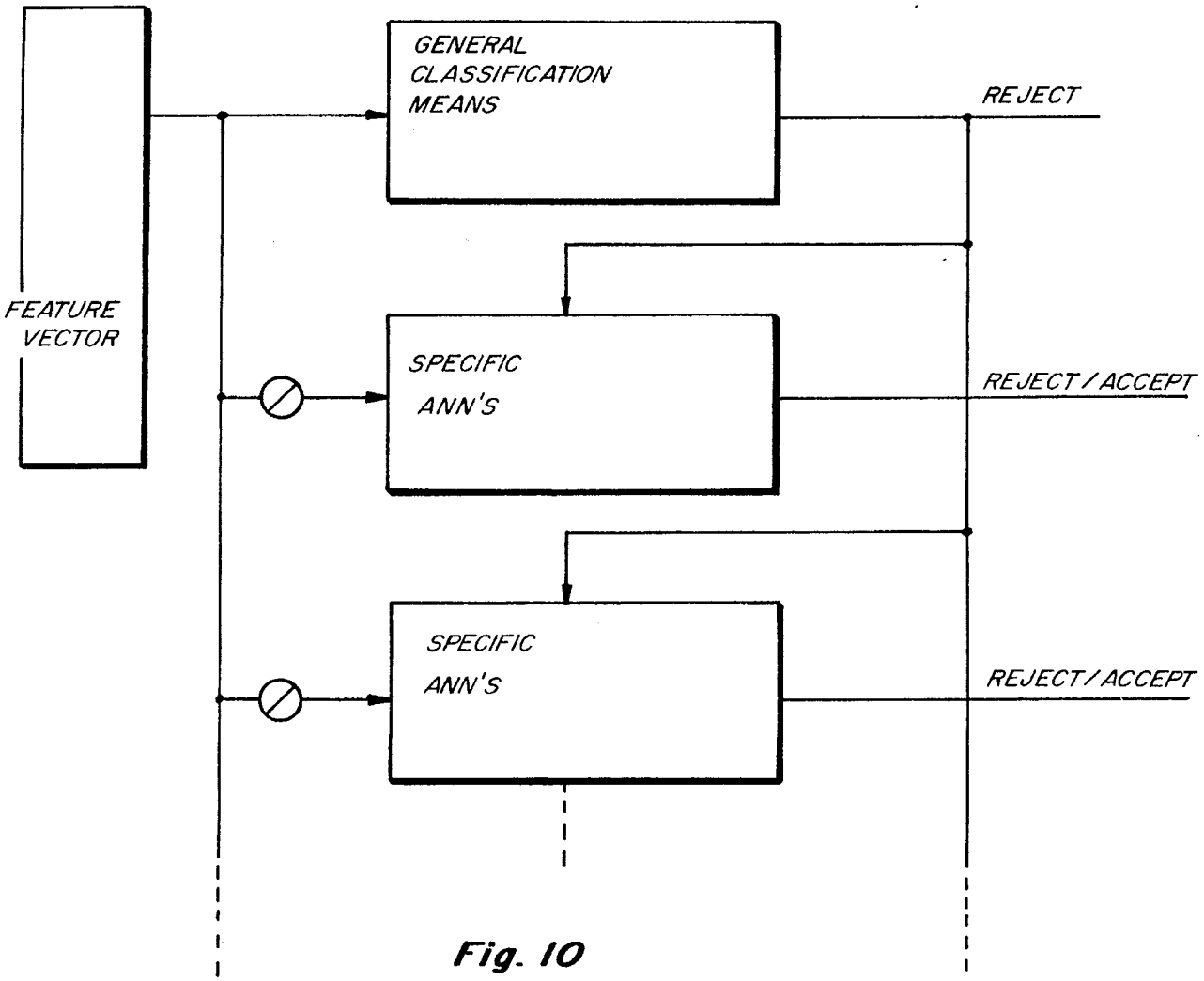
FIG. 10 is a block diagram of the ANN coin validation system showing the output of the feature vector circuit connected to the ANN validation means with the decision outputs.

A neuron in an ANN simulates a nerve cell in a biological neural network (see FIGS. 7 and 8). In a feed forward multi-layer neural network, each neuron receives an input from its previous layer or from an input and transmits its output to the next layer or to the output. The knowledge about the external world is encoded in a neural networks' synaptic weight, and information retrieval is done by manipulation of these weights with the input or feature vector.

Back propagation is the most powerful learning algorithm to train a neural network (modify its synaptic weights) under a supervised learning manner. Back propagation is a gradient descent algorithm. Initially, all weights in a neural network are randomized between similar − and + values such as between −0.5 and +0.5. Learning starts with the presentation of an input-target pair. The neural network matches the given input to an output. Comparison between the target and the output generates an error vector. It is this error vector, by back propagation through all of the neurons, that modifies synaptic weights in an attempt to minimize the mean square error objective function $\epsilon$. The gradient descent method repeatedly updates each weight, each updating being called a presentation and all presentations in a training set are termed a cycle. After being trained for a number of cycles, the neural network may reduce its error function to a minimum value. When this is done the network has been trained to discover the relationship between the input and target vectors in the training set.

The algorithm monitors learning as it proceeds so that learning may occur automatically when the partition space and the feature space have been discovered. This is accomplished by monitoring between the output of the neural network and the target with each presentation.

To avoid unnecessary computation, an error margin is introduced to the error between the neural network output and the target. This sets the error to zero before back propagation if the output is found to be within the margin of the target. In training a neural network it is sometimes possible to overshoot which indicates a larger learning rate and occurs when the error approaches zero or a very small value. There are ways to reduce the learning rate. One way is to decrease it at a certain fixed rate in the course of training. We choose the learning rate to be a certain percentage of the current error. Such methods are known and are not part of the present invention. It is also possible to use more than one ANN for the classification of all categories. This again is not at the heart of the invention.

After all of the neural networks have been trained, and such training is known the subject coin validation system is ready for classification. The signals with their distinctive features are then collected from the unknown object or coin and are formed into the feature vector (FV). The feature vector is first verified to see if it falls within an ellipse as defined by the mathematics of the system. The object or coin is rejected as being counterfeit if its feature vector is found not to fall in any ellipse. Otherwise it is assumed to be a valid coin. If not rejected the object or coin is considered as a candidate and the same feature vector is fed to the neural network and the output levels from the network are compared against each other. The object or coin is again subject to being rejected as counterfeit if the output value of the first neuron level is greater than that of the second neuron level. Otherwise it will be accepted as a valid coin belonging in a predetermined denomination or range of denominations.

It has been found by test of the coinage of several different countries including the United States, the United Kingdom and Germany that the various denominations can easily be separated in this manner. In addition, testing has shown that it is possible to solve the problem of different hardnesses with respect, for example, to the U.S. nickel vs. the Canadian nickel, the German DM vs. the U.K. 5 pence coin, the German DM vs. the Polish 20 zloty, the German DM vs. Australian 5 cent piece, and the U.K. 50 pence vs. the old U.K. 10 pence covered with foil. In all of these cases the similarities are substantial yet the separation process is effective. Thus the present invention presents a clustering of neural network devices in a coin validation systems. This novel application of ANN to a coin validation system has a number of advantages over existing coin mechanisms, and tests have demonstrated a more reliable and more flexible coin validation system using ANN.

The present system has self compensation capability by measuring air parameters against which all other features are compared. This significantly reduces performance variations among different units due to component deviations as well as environmental fluctuations. The dominant and salient features have been carefully selected and preprocessed and these features are only determined by the object under test. This means that a self-tuning or customer-tuned coin validator may be developed based on this technology. The present system in its preferred form, as stated, uses multi-frequency coin validation by capacitor switching in decaying oscillating tank circuits. The wide range of oscillation frequencies of the tank circuits covers almost the entire frequency band currently used in international acceptors. This means that the present system not only generates more features for discrimination but also makes it possible to produce a universal acceptor capable of classifying all coin denominations from various countries. Clustering such as ellipsoid clustering also relieves the requirements on training samples and simplifies the neural network training. The validation coin class for each coin is also narrowed which means that the counterfeit class occupies a large volume of the feature space.

Thus there has been shown and described novel means for separating coins or other objects from slugs or counterfeit coins, and it does so in a manner which enables the various coins to be identified as to validity, size, and denomination. It will apparent to those skilled in the art, however, that many changes, modifications, variations and other uses and applications of the present device are possible. All such changes, modifications, variations and other uses and applications which do not depart from the spirit and scope of the invention are deemed to be covered by the invention which is limited only by the claims which follow.

What is claimed:

1. A coin validation system for determining if a coin moving along a coin rail is a valid coin, and if so, its denomination comprising a rail along which coins move, coin sensor means located adjacent to the rail, said sensor means including at least one optical sensor for responding optically to movements of coins adjacent thereto, at least one magnetic sensor located in the vicinity of the optical sensor, said magnetic sensor including an inductive element, circuit means responsive to the optical sensor sensing the presence of a coin for energizing the magnetic sensor to produce a signal when the coin is moving adjacent thereto, the coin moving to a position to have mutual inductive cooperation with the inductive element whereby the inductive element produces an output signal having characteristics representative of the coin, signal preprocessing means operatively connected to the magnetic sensor including means for producing output responses representative of distinctive characteristics of the coin, feature extraction means for extracting from the output responses of the signal preprocessing means signal portions representative of predetermined distinctive features of the coin, means for producing a multi dimensional representation of the extracted features including a comparator circuit for comparing the multi dimensional representation with the center of an established cluster of selected coin denominations to determine the extent of the comparison therebetween such that when the comparison is of a certain nature the coin is determined to be acceptable and when the comparison is of a different nature the coin is not acceptable and artificial neural network classifier means having a first connection through first switch means to the feature extraction means and a second connection through other switch means to the comparator circuit, the artificial neural network classifier means having an output which identifies the denomination of coins that are determined by the comparator circuit to be acceptable.

2. The coin validation system of claim 1 including at least two optical sensors spaced along the coin rail and a magnetic sensor located in the vicinity of each of the optical sensors.

3. The coin validation system of claim 1 wherein the other switch means has a connection to a feature selection control line that determines which feature inputs are applied to the artificial neural network.

4. The coin validation system of claim 1 including circuit means connected to the optical sensor for determining the size of a coin moving down the coin rail.

5. A device for recognizing, identifying and validating objects such as coins used in a vending machine comprising a predefined path for coins of various denominations to move along on edge when deposited in a vending machine, sensor means positioned adjacent to the coin path for detecting the presence of coins moving thereby and for producing output signals representative of predetermined conditions of the coin including the presence of the coin and the metallic content of the coin, said sensor means including first and second sensor means located at spaced locations along the predetermined path in positions to be affected by movements of a coin thereby, each of said first and second sensor means including transmitting-receiving cells located adjacent the coin path whereby a coin moving along the coin path covers and uncovers the sensors in order, the sensors generating pulse signals, LC tank circuits including two pairs of coils and four capacitors, the tank circuits initially being connected to store energy determined by the initial condition thereof, each of said tank circuits when rung generating a damped sinusoidal waveform in response to movements of a coin thereby, each of the tank circuits having a distinctive frequency so that each tank circuit is rung twice at different frequencies by using switching means to switch between the different capacitors in parallel with the respective inductors when a coin is in the presence of a respective one of the inductors, means to process the signals produced by the respective tank circuits including means to produce a feature vector from the extracted information, means to form an ellipsoidal boundary cluster from the extracted information, means to compare the center of the ellipsoidal cluster with the coin pattern and if the comparison is of a certain type to generate a signal indicating the acceptability of the coin and the denomination thereof, and means to generate an output decision signal to indicate an acceptable coin if the comparison falls within the boundary and to generate a coin reject signal if it does not fall within the boundary.

6. A device for recognizing, identifying and validating objects such as coins deposited in a vending machine comprising:

a predefined path for coins to move along when deposited in a vending machine, sensor means positioned adjacent to the coin path including first sensor means for detecting the presence of a coin moving adjacent thereto and for producing output signals representative of predetermined positions of the coin and second sensor means responsive to the metallic, magnetic and other qualitative characteristics of the coin, circuit means connected to the second sensor means including means for generating a plurality of different frequencies for applying to the second sensor means as the coin moves in the vicinity of the second sensor means, means for ringing the circuit means to produce damped wave signals for applying to the coin by the second sensor means, the circuit means being rung at different frequencies when the coin is in the vicinity of the second sensor means, means for processing the signals produced by the second sensor means when the coin is in the presence thereof including means for generating signal components representing predetermined characteristics of the coin, means to form a cluster pattern from selected ones of the characteristic signal components produced by the second sensor means, comparator means to compare the cluster pattern with a pattern generated internally, and an artificial neural network classifier having means to generate an output decision signal to indicate an acceptable coin if the comparison falls within certain parameters and to generate a coin reject signal if the pattern comparison does not fall within the certain parameters, the artificial neural network classifier means having a first connection through a first switch means to the means for processing the signals produced by the second sensor means and a second connection through another switch means to the comparator means.

7. In a vending control device for installing on vending machines, improved means for determining if a coin is a valid coin, and if so, its denomination comprising a coin track along which coins move upon entering a vending machine, optical sensor means located along the track for optically sensing the presence of a coin including means for producing a signal when a coin is identified and terminating the signal when the coin has moved past the optical sensor means, other sensor means adjacent to the optical sensor means including means for generating an electro-magnetic signal when the coin is adjacent thereto, said signal being affected by the metallic content and physical characteristics of the coin and having features imposed thereon that are representative of the coin, means for extracting from the signals generated by the other sensor means components representative of predetermined coin characteristics imposed on the signal, means for combining preselected ones of the extracted components of the signal, ellipsoidal cluster classifier means connected to the feature extraction means, means to determine if a feature vector falls within the cluster classifier with a predetermined similarity threshold, if the similarity exceeds the threshold the coin is indicated as being a valid coin and otherwise the coin will be rejected, and means for applying the output of the feature extraction means and the output of the comparison means to a neural network classifier device having outputs on which decisions are made as to whether the coin should be accepted or rejected.

8. In the vending control device of claim 7 the other sensor means includes a tank circuit having inductance and resistance, the inductance of the tank circuit producing mutual inductance with the coin when the coin is adjacent thereto.

9. In the vending control device of claim 7 wherein the neural network classifier device includes a plurality of layers of neurons arranged in a first layer connected to receive the outputs of the comparison means, and a second layer connected to receive the outputs of the first layer, said second layer having a plurality of neurons, each having a decision output connected thereto.

10. In the vending control device of claim 9 wherein the neural network classifier device has three layers of neurons, the third layer having inputs connected to the outputs of the second layer, said third layer producing an output which indicates either an acceptable or an unacceptable coin.

11. In the vending control device of claim 7 including a source of pulses of different frequencies, means for applying the outputs of said source to the other sensor means whereby the other sensor means generates signal responses of different frequencies for coupling to the coin.

12. In the vending control device of claim 7 the optical sensor means includes a pair of spaced optical sensors responsive to movements of coins along the track adjacent thereto, the other sensor means including a magnetic sensor device positioned adjacent to each of the optical sensors, the optical sensors establishing conditions for exposing the adjacent other sensor means to the coin as the coin moves past.

13. In the vending control device of claim 11 wherein the source of pulses of different frequencies includes a plurality of tank circuits each having at least two different capacitors for selectively connecting across the respective inductors therein, each capacitor generating a different frequency when it is connected across its respective inductor.

14. In the vending control device of claim 7 including a timer circuit connected to the means for generating an electro-magnetic signal, said timer circuit having outputs for controlling the energizing of the other sensor means based upon the position of the coin adjacent thereto.

15. In the vending control device of claim 7 wherein the optical sensor means has associated with it means for determining the physical size of a coin moving into a covering position adjacent thereto, said means including means for generating signals when the coin moves to certain positions, said signals establishing a time relationship of coin movements which can be used to determine the coin size.

16. In the vending control device of claim 7 wherein the other sensor means includes means for predeterminately ringing the tank circuit to produce timed impulses in the form of damped waves, the damped waves having imposed thereon information from which predetermined characteristics of a coin can be extracted.

17. A device for recognizing, identifying and validating objects such as coins deposited in a vending machine comprising:

a predefined path for coins to move along when deposited in a vending machine, sensor means positioned adjacent to the coin path including first sensor means for detecting the presence of a coin moving adjacent thereto and for producing output signals representative of predetermined positions of the coin and second sensor means responsive to the metallic, magnetic and other qualitative characteristics of the coin, circuit means connected to the second sensor means including means for generating a plurality of different frequencies for applying to the second sensor means as the coin moves in the vicinity of the second sensor means including at least one LC tank circuit having a coil and at least two capacitors for selectively connecting across the coil, means for ringing the circuit means to produce damped wave signals for applying to the coin by the second sensor means, the circuit means being rung at different frequencies when the coin is in the vicinity of the second sensor means, means for processing the signals produced by the second sensor means when the coin is in the presence thereof including means for generating signal components representing predetermined characteristics of the coin, means to form a cluster pattern from selected ones of the characteristic signal components produced by the second sensor means, means to compare the cluster pattern with a pattern generated internally, and means to generate an output decision signal to indicate an acceptable coin if the comparison falls within certain parameters and to generate a coin reject signal if the pattern comparison does not fall within the certain parameters.

18. A device for recognizing, identifying and validating objects such as coins deposited in a vending machine comprising:

a predefined path for coins to move along when deposited in a vending machine, sensor means positioned adjacent to the coin path including first sensor means for detecting the presence of a coin moving adjacent thereto ant for producing output signals representative of predetermined positions of the coin and second sensor means responsive to the metallic, magnetic and other qualitative characteristics of the coin, circuit means connected to the second sensor means including means for generating a plurality of different frequencies for applying to the second sensor means as the coin moves in the vicinity of the second sensor means including an LC tank circuit including two pairs of coils and four capacitors, the tank circuit being initially connected to store energy as determined by the initial condition thereof, and means to ring the tank circuit at different frequencies to generate different damped wave sinusoidal wave forms when a coin is in a position to be coupled to the coils of the tank circuits, means for processing the signals produced by the second sensor means when the coin is in the presence thereof including means for generating signal components representing predetermined characteristics of the coin, means to form a cluster pattern from selected ones of the characteristic signal components produced by the second sensor means, means to compare the cluster pattern with a pattern generated internally, and means to generate an output decision signal to indicate an acceptable coin if the comparison falls within certain parameters and to generate a coin reject signal if the pattern comparison does not fall within the certain parameters.

* * * * *

UNITED STATES PATENT AND TRADEMARK OFFICE

CERTIFICATE OF CORRECTION

PATENT NO. : 5,485,908
DATED : January 23, 1996
INVENTOR(S) : Wang, et. al.

It is certified that error appears in the above-indentified patent and that said Letters Patent is hereby corrected as shown below:

Column 13, line 23, "ant" should be --and--.

Signed and Sealed this

Fourth Day of June, 1996

*Attest:*

*Attesting Officer*

BRUCE LEHMAN

*Commissioner of Patents and Trademarks*